US005921908A

United States Patent [19]

Bodan

[11] Patent Number: 5,921,908

[45] Date of Patent: Jul. 13, 1999

[54] FOLDING DEVICE AND METHOD FOR FOLDING FLAT PIECES OF LAUNDRY IN LONGITUDINAL DIRECTION

[75] Inventor: Janos Bodan, Frickenhausen, Germany

[73] Assignee: Orman B.V., XD Well, Netherlands

[21] Appl. No.: 08/866,006

[22] Filed: May 30, 1997

[51] Int. Cl.[6] ..... B31F 1/00

[52] U.S. Cl. ..... 493/418; 493/458; 493/450; 493/937; 53/116; 38/143

[58] Field of Search ..... 493/23, 35, 13, 493/17, 81, 123, 256, 313, 314, 405, 417, 418, 436, 450

[56] References Cited

U.S. PATENT DOCUMENTS

| | | | |
|---|---|---|---|
| 3,502,322 | 3/1970 | Cran | 270/69 |
| 3,797,371 | 3/1974 | Randle . | |
| 3,829,081 | 8/1974 | Gerstenberger | 493/418 |
| 4,279,611 | 7/1981 | Labombarde | 493/418 |
| 4,342,182 | 8/1982 | Dennis | 493/418 |
| 4,573,959 | 3/1986 | Baccianti | 493/418 |
| 4,614,512 | 9/1986 | Capdeboscq | 493/418 |
| 4,682,977 | 7/1987 | Buxton | 493/450 |
| 5,094,658 | 3/1992 | Smithe | 493/418 |
| 5,197,722 | 3/1993 | Adamski | 493/418 |
| 5,300,007 | 4/1994 | Kober | 493/23 |
| 5,435,802 | 7/1995 | Kober | 493/418 |
| 5,556,360 | 9/1996 | Kober et al. | 493/418 |

FOREIGN PATENT DOCUMENTS 0620310 10/1994 European Pat. Off. .

*Primary Examiner*—Linda Johnson
*Assistant Examiner*—Matthew Luby
*Attorney, Agent, or Firm*—Ladas & Parry

[57] ABSTRACT

Folding device for folding flat pieces of laundry like sheets in longitudinal direction, with a basis conveyor, a folding runner and a side conveyor lying higher alongside the folding runner wherein under the side conveyor an air chamber is situated to blow air both upwards and sidewards in order to lift a side portion of a piece of laundry and then transversely fold it over the folding runner.

12 Claims, 6 Drawing Sheets

FOLDING DEVICE AND METHOD FOR FOLDING FLAT PIECES OF LAUNDRY IN LONGITUDINAL DIRECTION

The invention relates to a folding device for folding flat pieces of laundry such as sheets in longitudinal direction and a method therefor.

U.S. Pat. No. 3,502,322 shows a folding device having a number of rotating endless conveyor belts, above which a folding runner with legs extending in longitudinal direction is arranged. On either side of the runner legs an air pipe is situated, which air pipes can blow air upwards through elongated openings in a platform, between the conveyor belts. Above each runner leg a curved screen is arranged. After a flat piece of laundry has been brought between the conveyor belts and the folding runner, air from the air pipes blows both edge areas of the piece of laundry upwards, which are then guided by the curved screens and folded over the middle section of the piece of laundry.

U.S. Pat. No. 5,300,007 shows a folding device in which the conveyor belts situated on either side of a broad middle conveyor belt are situated higher than the middle conveyor belt. The folding runner is situated just above the middle conveyor belt, and at the side of the folding runner legs air pipes are arranged, just under the elevated side conveyor belts. A flat piece of laundry is guided over the conveyor belts under the folding runner, and the side portions of the piece of laundry present on the elevated side conveyor belts are folded over the folding runner one after the other by blowing air sidewards and upwardly inclined from the air pipes over the folding runner, both side portions of the piece of laundry being guided by a grid above the conveyor belts.

A disadvantage of known devices is that a lot of air is needed for blowing the side portions upwards and folding them over, and that the quantity of air has to be in accordance with the heaviest pieces of laundry to be folded. During folding a lot of air can escape, so for that reason as well high air supply is needed.

Another disadvantage is that the side portions of a piece of laundry in the early stage of folding have to slide sidewards over the outer conveyor belts, which requires these belts to be smooth. This however is detrimental to the supply of the piece of laundry, because the smooth belts do not carry the side portions very well.

It is an object of the invention to provide an improved folding device and a method therefor.

According to the invention this object is achieved with a folding device for folding flat pieces of laundry such as sheets, wherein a fold is introduced in longitudinal direction of a piece of laundry, comprising a frame, a basis conveyor for the piece of laundry, a folding runner extending in longitudinal direction just above said basis conveyor, an upper conveyor for a side portion of the piece of laundry extending alongside said folding runner and above said basis conveyor, and air blowing means to fold the side portion of the piece of laundry over the folding runner, wherein the air blowing means are arranged in such a way that air can be blown upwards under the upper conveyor to lift the side portion of the piece of laundry and air can be blown sidewards over the folding runner to fold said side portion of the piece of laundry over the folding runner.

Because the air blowing means which are situated under the upper conveyor blow air upwards, the side portion of the piece of laundry present is lifted , so that it comes loose from the upper conveyor. The air blown sidewards can subsequently slide the side portion aside and over the folding runner without much resistance. Thus the side portion of the piece of laundry will not be completely lifted and folded over, and little air is lost during sliding over the folding runner. The folding device according to the invention can therefore save on used air considerably, which results in saving energy. Because the side portion of the piece of laundry is lifted the upper conveyor does not need to be smooth, so the side portion of a piece of laundry will be taken along well and the speed of transport can be high.

According to a preferred embodiment the air blowing means comprise an air chamber, which is situated under the upper conveyor and has openings in an upper wall to blow air upwards and has an opening in a side near the folding runner to blow air over the folding runner. This preferred embodiment is constructionally simple, because arranging various air pipes under the upper conveyor is not needed.

Preferably the air chamber is substantially triangular in cross section with a substantially horizontal side under the upper conveyor and a vertex near the folding runner, which vertex is substantially open. This form provides as small an air chamber as possible, wherein the openings can be arranged at the most suitable places.

Preferably an air pipe with openings for the supply of air is arranged in the air chamber.

According to a preferred embodiment the portion of the air chamber which is turned away from the folding runner has a substantially open side, in which opening the longitudinal air pipe is arranged, said pipe having openings to blow air substantially directed sidewards into the air chamber. Through the open side of the air chamber additional air is carried along by the air blown from the air pipes, so that less compressed air has to be supplied. Besides, most air is blown out through the open vertex of the air chamber, in the course of which that air is accelerated by the triangular section as well.

Preferably two folding runners are arranged above the basis conveyor, each provided with an upper conveyor and air blowing means, for folding over two side portions of the piece of laundry.

In order to check whether the folding has been implemented, preferably one or more sensors are arranged, so after folding the air supply to the air chamber can be stopped immediately.

The invention also provides for a method for folding a piece of laundry in longitudinal direction by using a folding device as described above, wherein the side portion of the piece of laundry is lifted from the upper conveyor by means of the upwardly blown air and starts floating above the upper conveyor, and is folded over a middle section of a piece of laundry by means of the sidewardly blown air.

The invention will be exemplified hereinafter by means of an preferred embodiment, with reference to the drawing.

FIG. 1 schematically shows a perspective view of the front portion of the folding device according to the invention;

Figure 1:
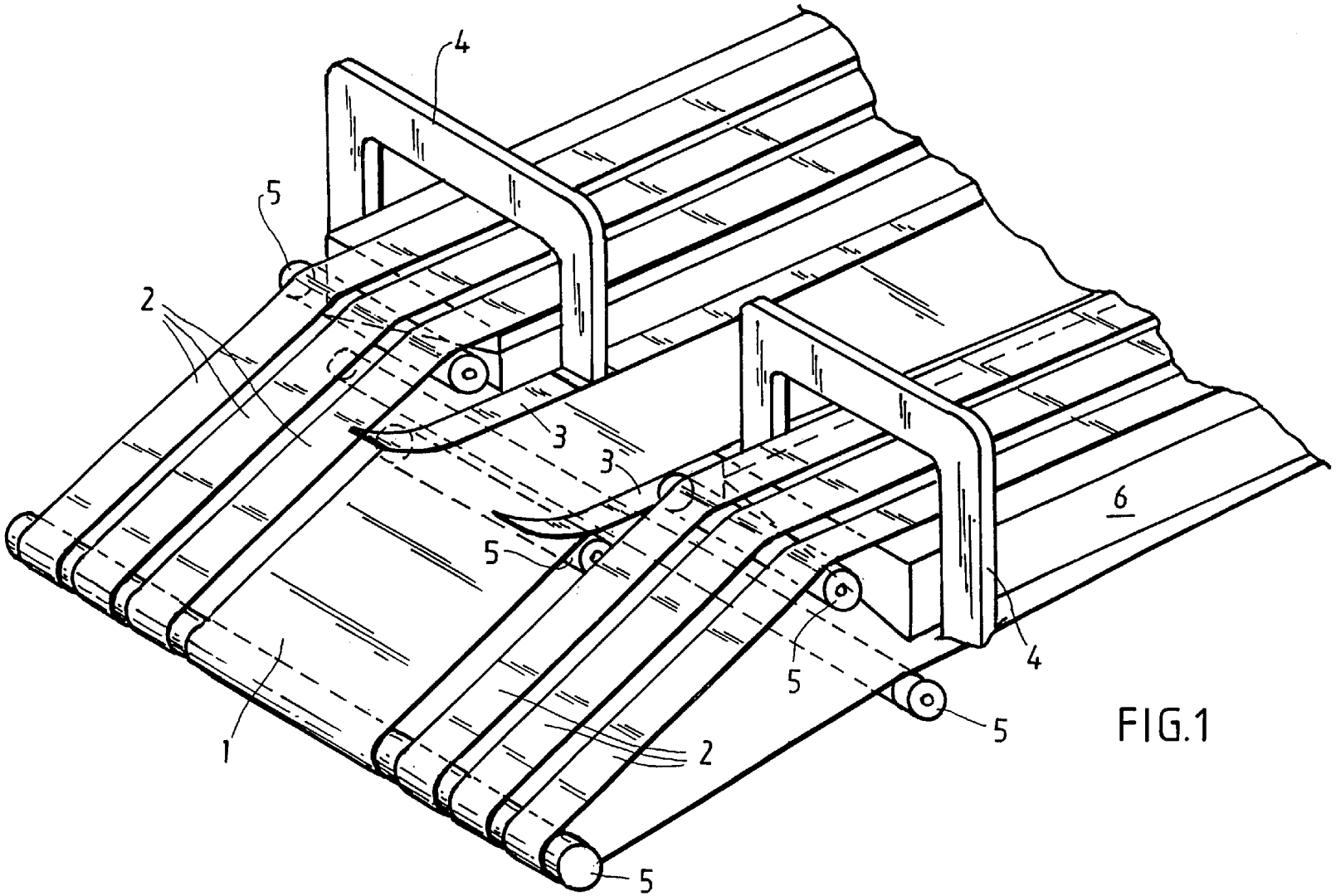

FIG. 1 schematically shows the front portion of the folding device according to the invention, wherein only the most important parts are represented.

A basis conveyor belt 1 and side conveyor belts 2 are guided over shafts 5 for endless rotation. The conveyor belts 1, 2 have a front portion which is upwardly inclined, to be able to supply the folding device with a piece of laundry either manually or automatically. After the first upwardly inclined portion of the basis conveyor belt 1 said belt runs horizontally, while the side conveyor belts 2 still run somewhat further upwards and subsequently also run horizontally. Right beside the side conveyor belts 2, just above the basis conveyor belt 1 two folding runners 3 are arranged, which protrude over the upwardly inclined portion of the basis conveyor belt 1 so that the middle section of a piece of laundry supplied is guided between the basis conveyor belt 1 and the folding runners 3. The folding runners 3 are attached to supports 4 which supports are shaped in such a way that they will not impede the piece of laundry which is conveyed. Under the side conveyor belts 2 on either side of each folding runner 3 an air chamber is arranged.

Figure 2:
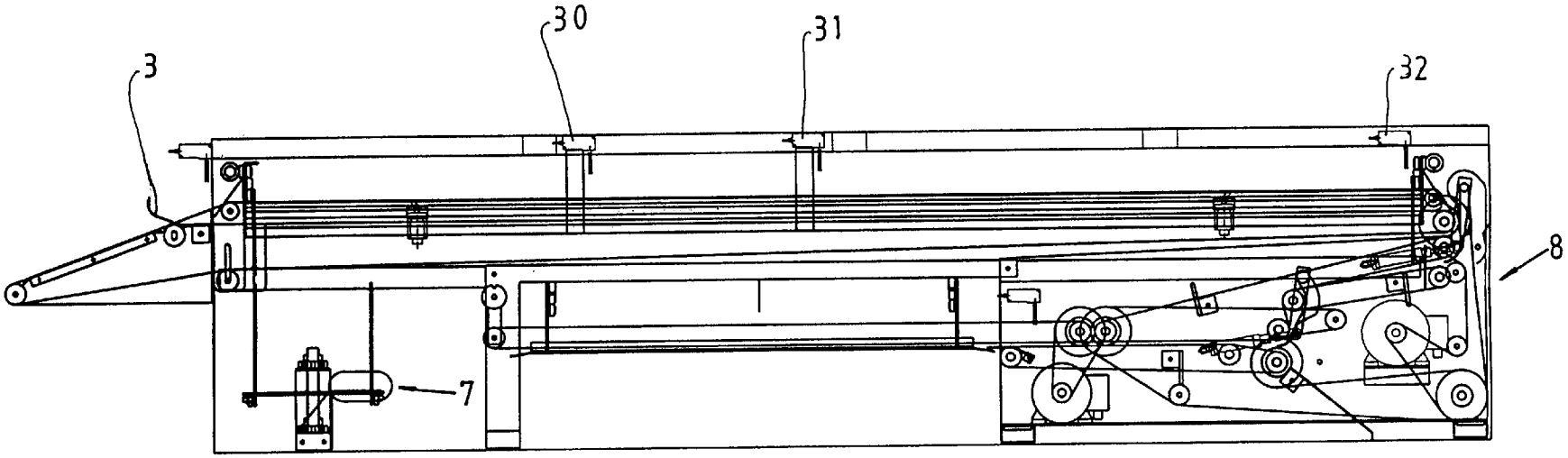
FIG. 2 shows a side view of the folding device according to the invention.
Figure 3:
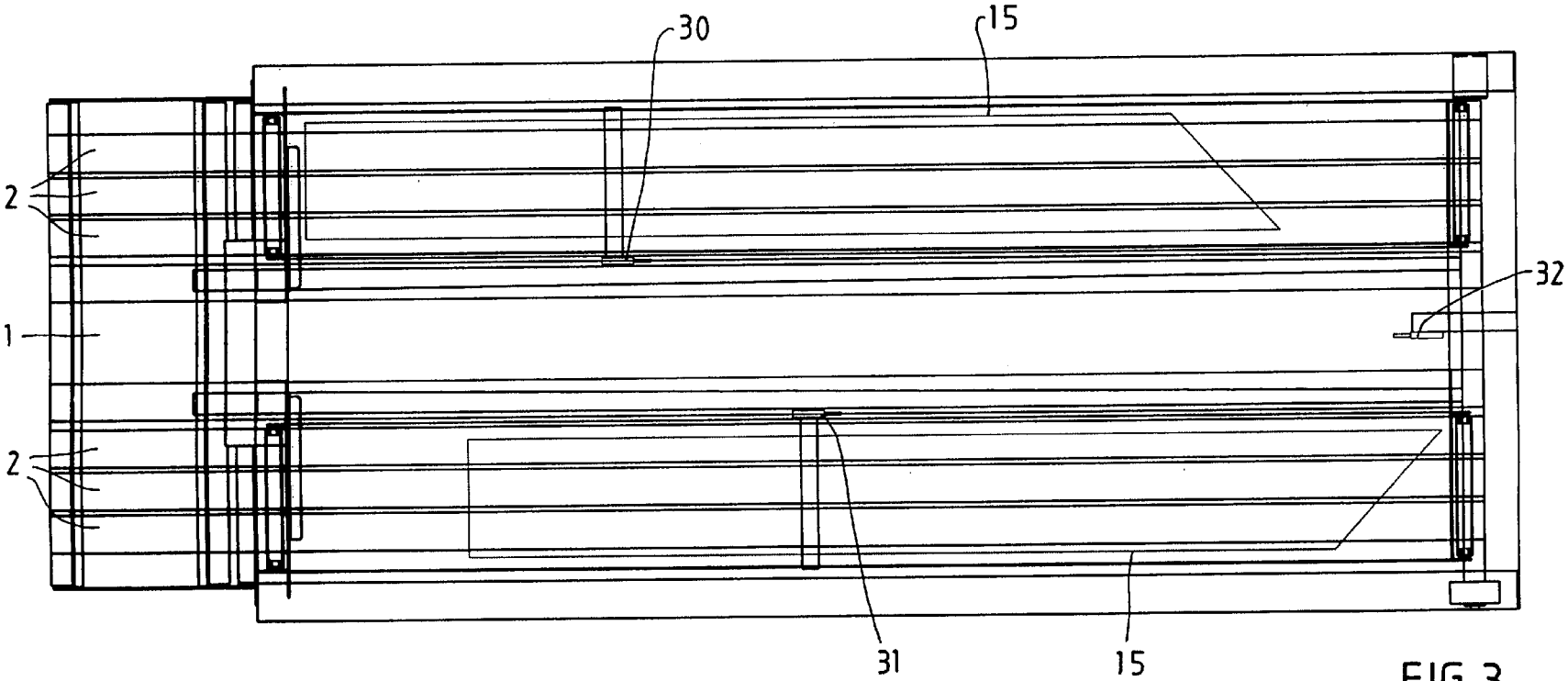
FIG. 3 shows a view from above of the folding device of FIG. 2.
Figure 4:
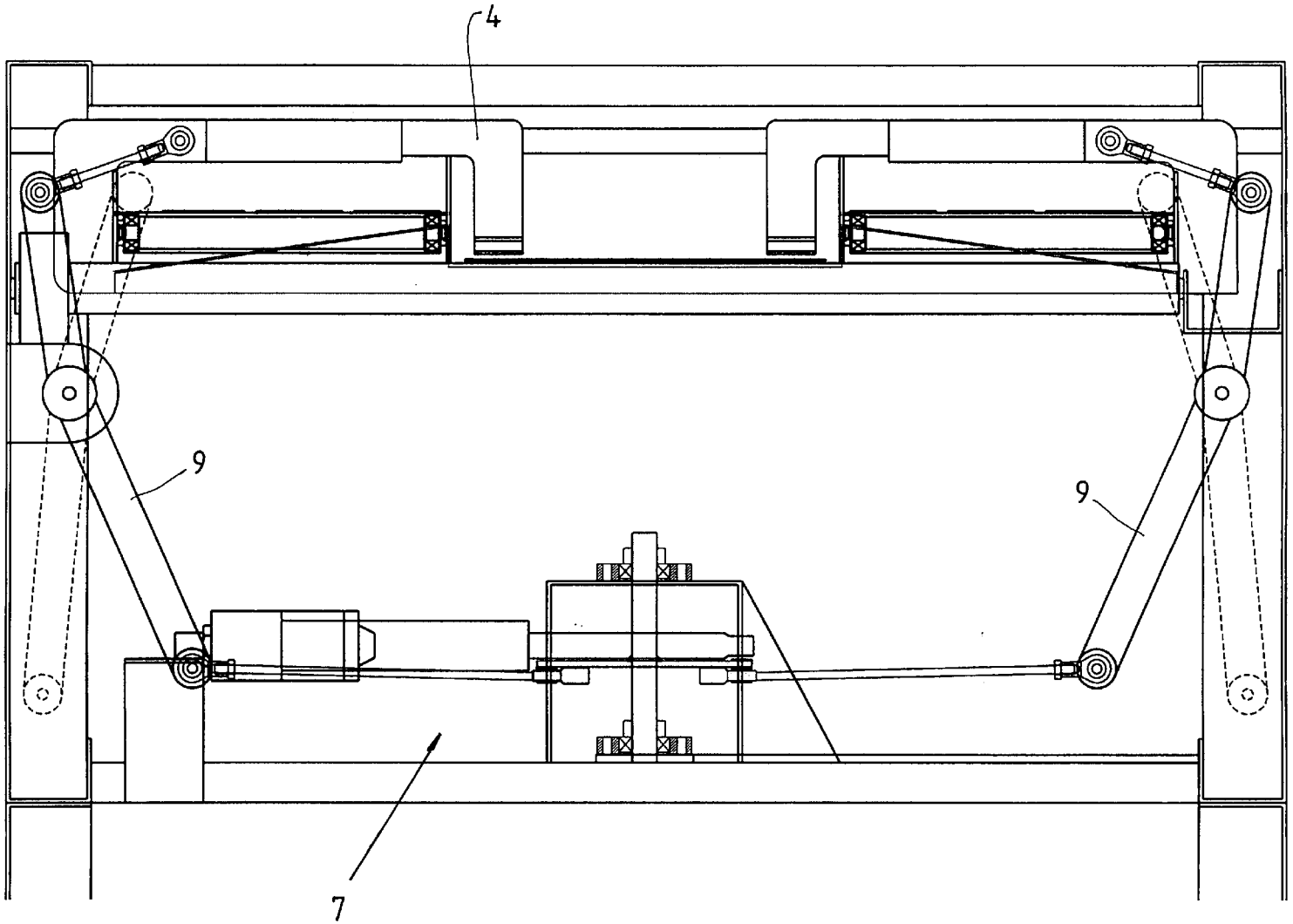
FIG. 4 shows a front view of the folding device of FIG. 2; and the FIGS. 5–8 show a cross section of the upper portion of the folding device on a larger scale during various stages of folding a piece of laundry.

The FIGS. 2, 3 and 4 show the folding device respectively in a side view, a view from above and a front view. FIG. 2 shows a drive 8 for the conveyor belts 1, 2 and an adjustment unit 7, which is better visible in FIG. 4, with which by using levers 9 both folding runners 3 together with the air chambers and the side conveyor belts 2 can be shifted symmetrically in relation to the longitudinal axial line from the folding device, so that pieces of laundry of various widths can be folded. FIGS. 2 and 3 also show that sensors 30, 31 and 32 are arranged to check whether the folding has been implemented.

Figure 5:
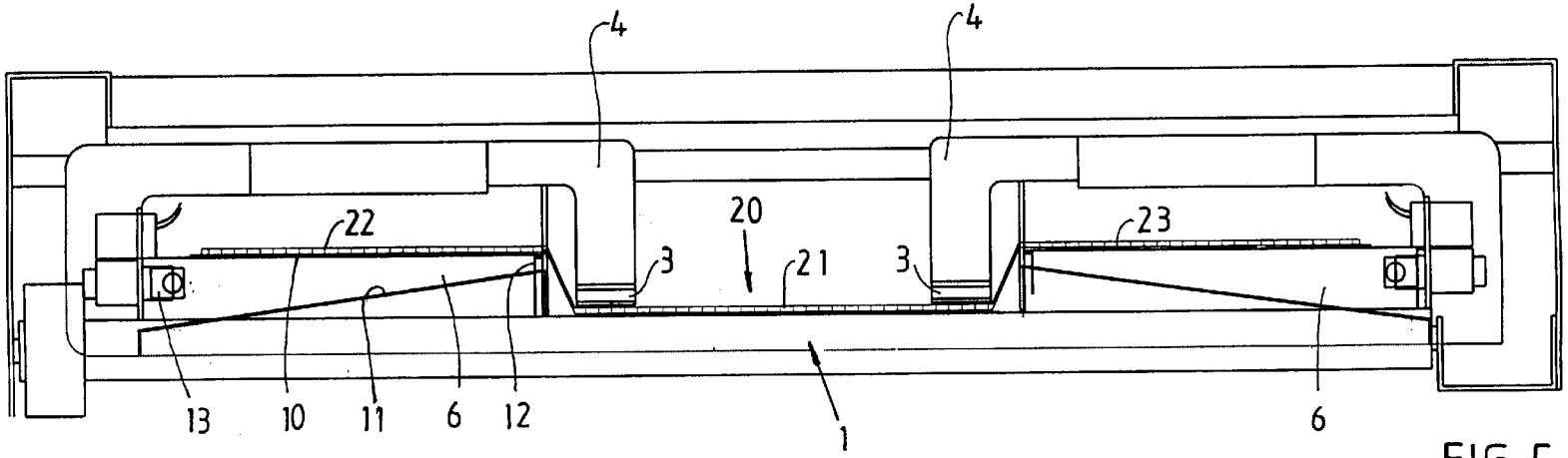
Figure 6:
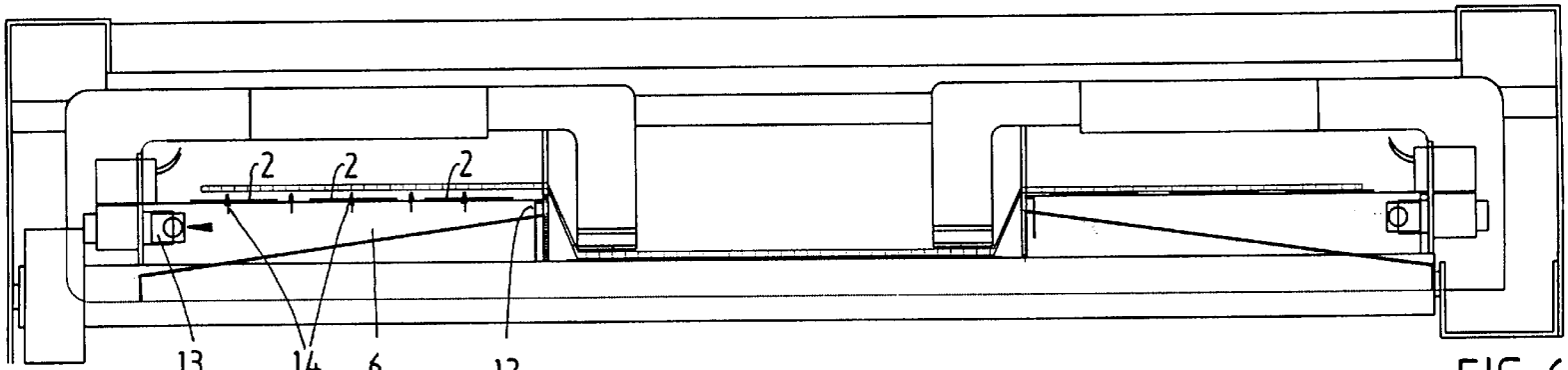

FIGS. 5–8 show the upper portion of the folding device in cross section on a larger scale. In FIG. 5 the folding runners 3 and their supports 4 are provided with reference numbers, as are both air chambers 6. Each air chamber 6 has a horizontal upper wall 10 and a inclined lower wall 11, which meet each other near the accompanying folding runner 3 and form an opening 12 through which air is blown. The side opposite said opening 12 is open and in this opening an air pipe 13 is arranged, said pipe having openings to blow air sidewards into the air chamber 6. FIG. 6 also shows openings 14 in the upper wall 10 of the air chamber 6, and three side conveyor belts 2 which run over the air chamber 6. Both air chambers 6 are mirror symmetric in relation to the longitudinal axial line of the folding device. The side conveyor belts 2 are perforated (e.g., spaced from each other).

FIG. 3 shows areas in the upper wall of the air chambers surrounded by dotted lines 15, in which areas the openings 14 are arranged.

The method for folding a piece of laundry will now be exemplified by means of the FIGS. 5–8.

After a piece of laundry 20 with a middle section 21, a left side portion 22 and a right side portion 23 has been supplied on the upwardly inclined portion of the conveyor belts 1, 2 it is guided under the folding runners 3 over the basis conveyor belt 1 and the side conveyor belts 2, until the piece of laundry in its entirety is guided past the supports 4 of the folding runners 3. This situation is represented in FIG. 5.

Figure 7:
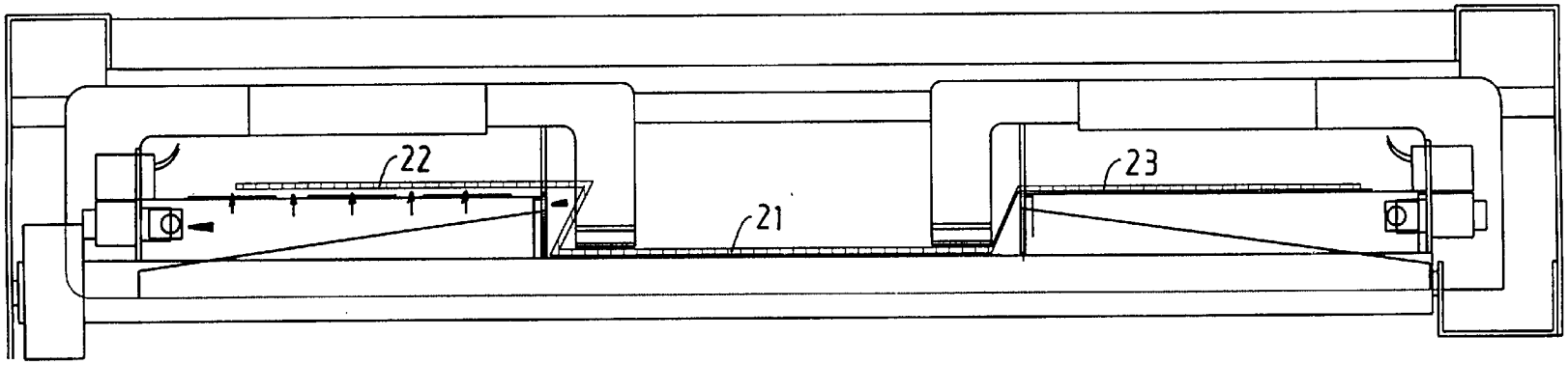
Figure 8:
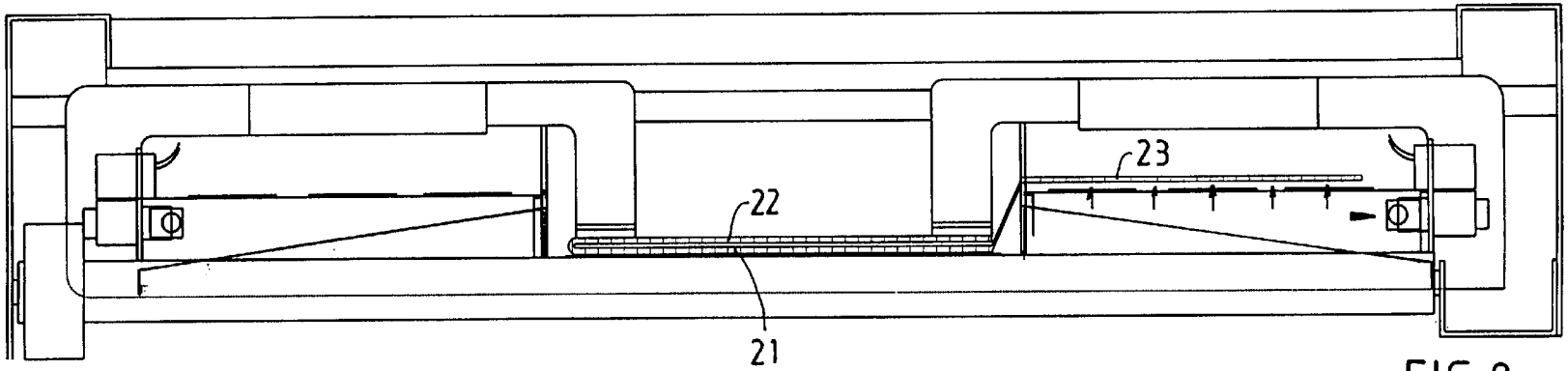

FIG. 6 shows the situation in which air is supplied through the air pipe 13. This air will partly escape through the openings 14 in the upper wall 10 of the air chamber 6 and lift the left side portion 22 of the piece of laundry 20 via the perforated belts 2, resulting in a kind of air cushion underneath the left side portion 22 on which the left side portion 22 is floating. After the left side portion is floating on the air cushion the remaining portion of the air supplied via the side opening 12 in the air chamber 6 will push aside the left side portion 22 as a result of which the left side portion 22 is folded over the left runner 3. FIG. 7 shows a moment during this pushing aside of the left portion 22. FIG. 8 shows that the left side portion 22 in its entirety has been folded over the middle section 21 of the piece of laundry 20. This situation is detected by the sensor 30 (see FIG. 3), after which the air supply to the air pipe 13 is stopped. Subsequently air is supplied to the right air chamber 6 to fold the right side portion 23 of the piece of laundry 20 over the right folding runner 3 in a analogous way. The sensor 31 (see FIG. 3) detects the completion of folding the right side portion 23.

Folding can be implemented while the piece of laundry is transported by the conveyor belts 1, 2. That is why the right air chamber is situated further back in the direction of transport of the folding device than the left air chamber, to achieve that the air chamber is approximately as long as the longest piece of laundry to be folded and as little air as possible is lost through openings in the air chamber which are not covered by a piece of laundry.

The sensor 32 (see FIG. 3) checks whether both folds are present and can control a lateral folding device, which can be linked after the longitudinal folding device according to present invention to subsequently fold the piece of laundry that has been folded in longitudinal direction one or more times in lateral direction.

The invention is not limited to the embodiment described above; the scope of protection will be determined by the claims following after this.

I claim:

1. A folding device for folding a flat piece of laundry, wherein a fold is introduced in the piece of laundry in a longitudinal direction, the folding device comprising a frame, a basis conveyor for conveying the piece of laundry in the longitudinal direction, a folding runner extending in the longitudinal direction just above the basis conveyor, an upper conveyor for supporting a first side portion of the piece of laundry extending alongside the folding runner and above the basis conveyor, and air blowing means to fold the first side portion of the piece of laundry over the folding runner, wherein the air blowing means are arranged in such away that air is blown upwards and through the upper conveyor to lift the first side portion of the piece of laundry from the upper conveyor and air is blown sidewards over the folding runner to fold the first side portion of the piece of laundry over the folding runner, wherein the air blowing means comprise an air chamber under the upper conveyor, the air chamber having upper openings in an upper wall for the blowing of the air upwards and a side opening in a side by the folding runner for the blowing of the air sidewardly over the folding runner for the upwards blown air to lift the first side portion of the piece of laundry above the upper conveyor and the sidewardly blowing air to fold the lifted first side portion of the piece of laundry over a middle section of the piece of laundry.

2. The folding device according to claim 1, wherein the air chamber is substantially triangular in cross section with a substantially horizontal side under the upper conveyor with the upper openings and a vertex by the folding runner with the side opening.

3. The folding device according to claim 1, and further comprising a first sensor by the folding runner, whereby to check whether the fold is completed.

4. The folding device according to claim 1, wherein the folding runner, the upper conveyor and the air blowing means are adjustable transverse to the longitudinal direction.

5. The folding device according to claim 1, wherein the upper conveyor comprises a number of spaced endless conveyor belts and wherein the air blowing means are arranged under an upper run of the conveyor belts.

6. The folding device according to claim 1, wherein the folding is carried out while the basis conveyor is conveying the piece of laundry.

7. The folding device according to claim 1, wherein the air blowing means blows the air in a pulsating manner.

8. The folding device according to claim 1, and further comprising an air pipe for supply of the air to the air chamber.

9. The folding device according to claim 8, wherein a portion of the air chamber opposite the side opening is substantially open and has the air pipe, the air pipe supplying the air substantially directed towards the side opening.

10. The folding device according to claim 1, and further comprising an opposite side folding runner, upper conveyor and air blowing means for folding an opposite side portion of the piece of laundry.

11. The folding device according to claim 10, and further comprising a second sensor at an end of the basis conveyor, whereby to check whether both folds are present in the piece of laundry.

12. The folding device according to claim 10, and further comprising means effective after the folding of the first side portion for the folding of the opposite side portion.

* * * * *